US011787200B2

(12) United States Patent
Glueck

(10) Patent No.: US 11,787,200 B2
(45) Date of Patent: Oct. 17, 2023

(54) EMBOSSING STAMP, PRESSING TOOL AND METHOD FOR MARKING A MOTOR VEHICLE COMPONENT

(71) Applicant: Bayerische Motoren Werke Aktiengesellschaft, Munich (DE)

(72) Inventor: Bernhard Glueck, Fuerstenfeldbruck (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 17/427,971

(22) PCT Filed: Feb. 20, 2020

(86) PCT No.: PCT/EP2020/054449

§ 371 (c)(1),
(2) Date: Aug. 3, 2021

(87) PCT Pub. No.: WO2020/187523

PCT Pub. Date: Sep. 24, 2020

(65) Prior Publication Data

US 2022/0126597 A1 Apr. 28, 2022

(30) Foreign Application Priority Data

Mar. 18, 2019 (DE) ..... 10 2019 106 751.0

(51) Int. Cl.
*B41J 3/38* (2006.01)

(52) U.S. Cl.
CPC ..... *B41J 3/38* (2013.01)

(58) Field of Classification Search
CPC .... B41J 3/38; B41J 3/047; B41J 3/413; B41F 19/02; B41M 1/24; B41M 5/0058
See application file for complete search history.

(56) References Cited

U.S. PATENT DOCUMENTS 4,088,216 A * 5/1978 LaManna ..... B41J 3/387 400/582
4,198,906 A 4/1980 Fujikawa et al.
(Continued)

FOREIGN PATENT DOCUMENTS

AT 398 916 B 2/1995
DE 36 07 768 A1 10/1986
(Continued)

OTHER PUBLICATIONS

International Search Report (PCT/ISA/210) issued in PCT Application No. PCT/EP2020/054449 dated Jun. 24, 2020 with English translation (six (6) pages).
(Continued)

*Primary Examiner* — Jennifer Bahls
*Assistant Examiner* — Quang X Nguyen
(74) *Attorney, Agent, or Firm* — Crowell & Moring LLP

(57) ABSTRACT

An embossing stamp for embossing an identifying mark on a motor vehicle component includes an embossing wheel assembly. The embossing wheel assembly can be set individually for the motor vehicle component being embossed depending on the identifying mark to be stamped. The embossing wheel assembly includes a negative representation of the identifying mark to be stamped. A transmission device is provided to transmit an identification signal characterizing the embossed identifying mark and the motor vehicle component marked with the identifying mark to a computer device external to the embossing stamp.

17 Claims, 1 Drawing Sheet

(56) References Cited

U.S. PATENT DOCUMENTS

| | | | | |
|---|---|---|---|---|
| 4,227,454 | A | 10/1980 | Speicher | |
| 8,047,132 | B2 | 11/2011 | Lu et al. | |
| 2005/0022680 | A1* | 2/2005 | Plattet | B44B 5/0076 101/3.1 |
| 2018/0257123 | A1* | 9/2018 | Kitamura | B21D 22/04 |

FOREIGN PATENT DOCUMENTS

| | | | | |
|---|---|---|---|---|
| DE | 198 35 993 | A1 | 2/2000 | |
| DE | 10 2004 034 833 | A1 | 2/2005 | |
| DE | 10 2006 056 388 | B3 | 5/2008 | |
| DE | 10 2011 052 586 | A1 | 2/2013 | |
| DE | 10 2014 201 273 | A1 | 7/2015 | |
| DE | 10 2016 010 603 | B3 | 12/2017 | |
| EP | 1 491 269 | A1 | 12/2004 | |
| GB | 2174957 | A * | 11/1986 | B41F 33/009 |
| JP | 53-135726 | A | 11/1978 | |
| WO | WO-2018163057 | A1 * | 9/2018 | B42D 25/20 |

OTHER PUBLICATIONS

German-language Written Opinion (PCT/ISA/237) issued in PCT Application No. PCT/EP2020/054449 dated Jun. 24, 2020 (six (6) pages).

German-language Search Report issued in German Application No. 102019106751.0 dated Nov. 18, 2019 with partial English translation (11 pages).

English translation of Chinese-language Office Action issued in Chinese Application No. 202080007338.3 dated Nov. 4, 2022 (nine (9) pages).

* cited by examiner

EMBOSSING STAMP, PRESSING TOOL AND METHOD FOR MARKING A MOTOR VEHICLE COMPONENT

BACKGROUND AND SUMMARY OF THE INVENTION

The present subject matter relates to an embossing stamp for embossing an identifying mark on a motor vehicle component and a pressing tool for forming a motor vehicle component and a method for identifying a motor vehicle component.

An embossing stamp is set up to apply markings to non-flat surface regions of components to be labelled. The embossing stamp is pressed under high pressure onto the surface of the component or workpiece to be marked, in order to produce the corresponding marking by an embossing.

It is an object of the present subject matter to devise an embossing stamp for embossing an identifying mark on a motor vehicle component, a pressing tool and a method for identifying a motor vehicle component which permits particularly advantageous documentation of the identifying mark stamped on the motor vehicle component.

According to the present subject matter, this object is achieved by an embossing stamp for embossing an identifying mark on a motor vehicle component, by a pressing tool for forming a motor vehicle component, and by a method for identifying a motor vehicle component. Advantageous embodiments of the present subject matter are the subject matter of the dependent patent claims and the description.

An aspect of the present subject matter relates to an embossing stamp for embossing an identifying mark on a motor vehicle component. The embossing stamp comprises an embossing wheel assembly which can be set individually for the motor vehicle component to be embossed, depending on the identifying mark to be stamped. The embossing wheel assembly has the identifying mark to be stamped represented as a negative impression of the identifying mark. In other words, the identifying mark can be impressed onto the motor vehicle component using the embossing wheel assembly via pressure, wherein the identifying mark to be stamped can be set on a surface of the embossing wheel assembly as a negative. To permit particularly advantageous documentation of the identifying mark impressed onto the motor vehicle component, according to the present subject matter a transmission device is provided on the embossing stamp, using which an identification signal characterizing the stamped identifying mark can be provided for an electronic computing device external to the embossing stamp. The transmission device of the embossing stamp is set up to provide the identification signal which characterizes the embossed identifying mark via radio and/or via a cable connection for the electronic computing device, which is arranged outside the embossing stamp. In the computing device, the identifying mark and the motor vehicle component marked with the identifying mark can be stored in a manner associated with each other. The method makes it possible that, with an embossing wheel assembly which cannot be seen or is difficult to see on the embossing stamp, the identifying mark stamped on the respective motor vehicle component can be documented particularly simply and reliably by being stored in the electronic computing device.

In this connection, it has proven to be particularly advantageous if the identification signal characterizes both the identifying mark stamped and also the motor vehicle component identified by the identifying mark. In this way, the stamped identifying mark can already be assigned to the associated motor vehicle component using the transmission device, which makes particularly error-free documentation possible. For example, the transmission device receives from the embossing wheel assembly the set identifying mark to be stamped and, furthermore, determines the motor vehicle component which is to be identified with the identifying mark, and provides the identification signal characterizing the identifying mark to be stamped and the associated motor vehicle component for the computing device. Upon receiving the identification signal, the computing device can determine particularly simply on which motor vehicle component the identifying mark has been impressed.

In a development of the present subject matter, it has proven to be advantageous if the embossing stamp comprises a receiver device, using which a setting signal can be received and provided for the embossing wheel assembly, wherein the setting signal characterizes an identifying mark to be set in the embossing wheel assembly. The identifying mark to be set in the embossing wheel assembly can be provided, for example, from the computing device that is external to the embossing stamp, in which the electronic computing device predefines to the embossing stamp which identifying mark is to be impressed on the motor vehicle component. Following receipt of the setting signal using the receiver device, the embossing wheel assembly can be set automatically in order to set the identifying mark to be stamped as a negative on the surface of the embossing wheel assembly. To emboss the motor vehicle component, the identifying mark to be stamped via the surface of the embossing wheel assembly having the negative is stamped under pressure onto a surface of the motor vehicle component. The automatic setting of the embossing wheel assembly permits particularly simple and rapid setting of the embossing wheel assembly, in particular in an arrangement of the embossing wheel assembly in the embossing stamp which is not accessible or difficult to access.

It has proven to be particularly advantageous if the identifying mark characterizes a country and/or a factory and/or a part identifier of the motor vehicle component. Here, the country in which the motor vehicle component has been produced and/or the factory in which the motor vehicle component has been produced and/or a part identifier identifying the motor vehicle component uniquely can be characterized by the identifying mark. Thus, the identifying mark permits, firstly, unambiguous identification of the motor vehicle component and reproduction of further component information characterizing the motor vehicle component, such as the country in which the motor vehicle component has been produced and/or the factory in which the motor vehicle component has been produced. Thus, the identifying mark is particularly meaningful.

In a further refinement of the present subject matter, provision is made for the embossing wheel assembly to have at least one stamp wheel, which can be rotated about a mid-axis to set the identifying mark to be stamped and which, on the circumference, has a plurality of identifier elements, from which the identifying mark can be selected or put together. The embossing wheel assembly comprises a plurality of mutually concentrically arranged stamp wheels, in which the identifying mark consisting of multiple identifier elements can be put together. To put the identifying mark together, the respective stamp wheels are rotatable about their mid-axis, in order to select an identifier element as part of the identifying mark for each stamp wheel. The respective identifier elements can be molded onto respective surfaces of the stamp wheels as negatives. Using the at least one stamp wheel, the identifying mark can be put together simply and flexibly from the multiple identifier elements. If the embossing wheel assembly has only one stamp wheel, then the identifying mark is an individual one of the multiple identifier elements of the stamp wheel, which can be selected by rotating the stamp wheel about the mid-axis.

An aspect of the present subject matter relates to a pressing tool for forming a motor vehicle component, having an embossing stamp as has already been described in connection with the embossing stamp according to the present subject matter, whereby the identifying mark can be stamped into the motor vehicle component using the embossing stamp during the forming of the motor vehicle component. The pressing tool is set up in particular to form the motor vehicle component under pressure, wherein the motor vehicle component can be embossed with the identifying mark during this forming process. For this purpose, the embossing stamp is integrated into the pressing tool. The transmission device providing the identification signal permits particularly advantageous documentation of the identifying mark impressed on the motor vehicle component using the embossing stamp of the pressing tool during the forming.

An aspect of the present subject matter relates to a method for identifying a motor vehicle component. In the method, the motor vehicle component is formed and/or processed in a pressing tool. During the forming and/or processing, the motor vehicle component is embossed with an identifying mark using an embossing stamp. The identifying mark stamped using the embossing stamp is provided using a transmission device of the embossing stamp for a computing device external to the embossing stamp. In the, in particularly electronic, computing device external to the embossing stamp, the identifying mark stamped in the motor vehicle component is stored in a manner associated with the embossed motor vehicle component. The method permits particularly advantageous documentation of respectively formed motor vehicle components and the respective identifying marks stamped into the respective motor vehicle component during the forming.

In this connection, it has proven to be particularly advantageous if a setting signal characterizing an identifying mark to be set in the embossing wheel assembly is received using a receiver device and provided for the embossing wheel assembly, the identifying mark to be set is set in the embossing wheel assembly, and the identifying mark is stamped into the motor vehicle component using the embossing wheel assembly. The receiver device can be part of the embossing stamp. Using the receiver device and the setting signal, the identifying mark to be stamped can be predefined particularly simply for the embossing wheel assembly from outside the embossing stamp. For example, using the electronic computing device, the identifying mark to be impressed into the motor vehicle component can be predefined and provided in the form of the setting signal for the embossing stamp. Using the setting signal, for example, two first characters of an identifying mark comprising a plurality of characters can be predefined. The remaining characters of the identifying mark can be adjusted mechanically and automatically with a respective stroke of the pressing tool, in order to allocate continuous part identifiers.

In a development of the method, it has proven to be advantageous if a blank identifier lasered into the motor vehicle component to be formed is determined and is stored in the computing device in a manner associated with the motor vehicle component and the identifying mark. The motor vehicle component is, for example, formed from a blank which is provided with the lasered blank identifier. For particularly advantageous documentation, provision is therefore made for the blank identifier of the motor vehicle component to be read and to be provided to the electronic computing device. The blank identifier can, for example, be determined using a detection device and provided for the electronic computing device. In the electronic computing device, the blank identifier determined can be stored in a database in a manner associated with the motor vehicle component and the identifying mark. In this way, it is particularly simple to determine the blanks from which the formed motor vehicle component has been produced. This permits particularly advantageous monitoring of a production process for the motor vehicle component.

In this connection, it has proven to be particularly advantageous if, depending on the blank identifier determined, a material and/or at least one process parameter of the motor vehicle component is determined and is stored in the computing device in a manner associated with the motor vehicle component. For example, using the electronic computing device and depending on the blank identifier determined, the material of the motor vehicle component and/or the at least one process parameter of the motor vehicle component is determined and, via the assignment of the blank identifier to the motor vehicle component, stored in a manner associated with the motor vehicle component. Here, the material represented by the blank identifier characterizes an initial raw material of the motor vehicle component. The at least one process parameter of the motor vehicle component can be a production parameter characterizing the blank converted into the motor vehicle component and/or the motor vehicle component in process steps preceding or following the forming. In this way, particularly comprehensive documentation of a production process for the motor vehicle component is possible.

Advantages and advantageous developments of the embossing stamp according to the present subject matter are to be viewed as advantages and advantageous developments of the pressing tool according to the present subject matter and of the method according to the present subject matter, and vice versa. For this reason, the further advantages and advantageous developments of the pressing tool and of the method will not be described once more here.

Further features of the present subject matter emerge from the claims, the figures and the figure description. The features and feature combinations previously described in the description and the features and feature combinations mentioned below in the figure description and/or shown on their own in the figures can be used not only in the respectively specified combination but also in other combinations or on their own.

DETAILED DESCRIPTION OF THE DRAWINGS

Figure 1:
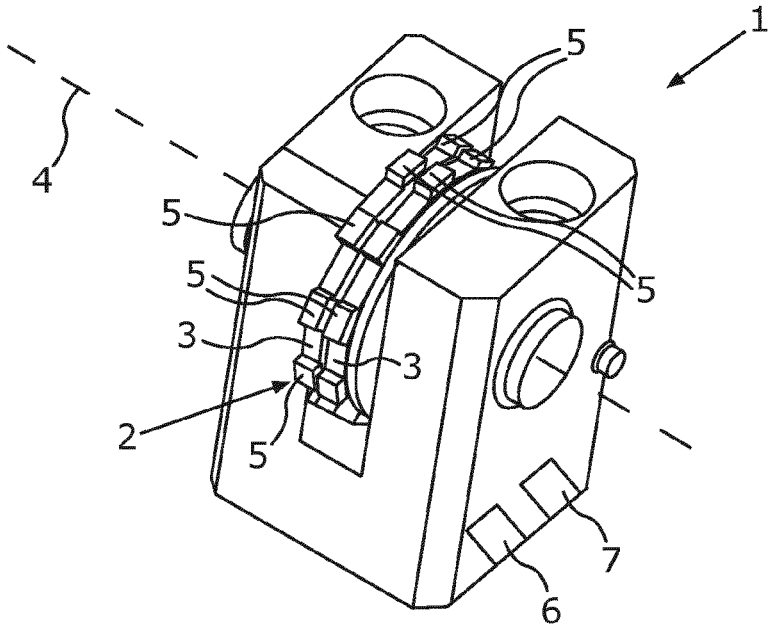
FIG. 1 shows a schematic perspective view of an embossing stamp for embossing an identifying mark onto a motor vehicle component, wherein the embossing stamp is set up to be integrated into a pressing tool for forming a motor vehicle component, to emboss the motor vehicle component with the identifying mark during the forming.
Figure 2:
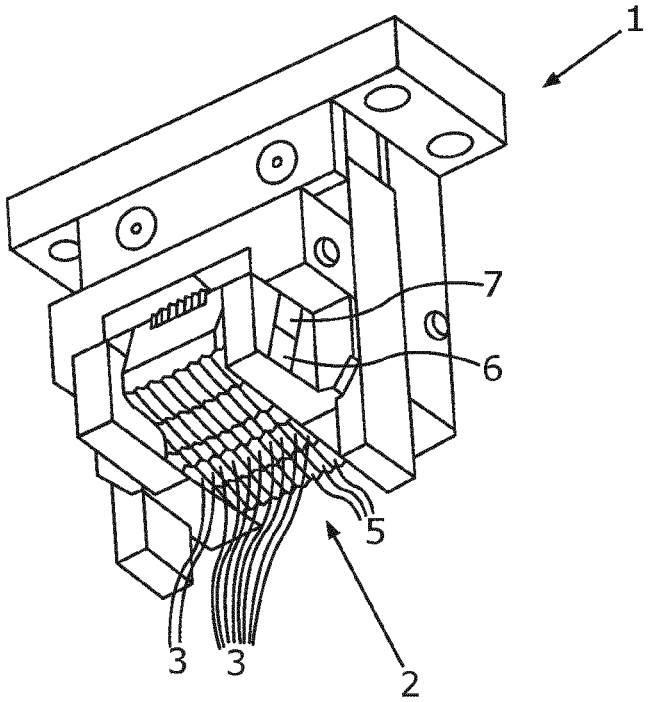
FIG. 2 shows a schematic perspective view of the embossing stamp, wherein the embossing stamp comprises a sprung switching unit for setting an embossing wheel assembly of the embossing stamp, which switches during a press return stroke, so that the identifying mark to be stamped is set during the press return stroke.

The embossing stamps 1 can be integrated into a pressing tool for forming a motor vehicle component in the present case, to emboss the motor vehicle component with an identifying mark during the forming.

To emboss the motor vehicle component, the embossing stamp 1 comprises an embossing wheel assembly 2 which, on its surface, has the identifying mark to be impressed onto the motor vehicle component as a negative. The embossing wheel assembly 2 can be set individually for the motor vehicle component to be embossed, to provide the motor vehicle component with the individual identifying mark. In the present case, the embossing wheel assembly 2 comprises a plurality of stamp wheels 3, which are each stacked on one another concentrically along their mid-axes 4 and are rotatable relative to one another about their mid-axis 4. In each case a plurality of identifier elements 5 are arranged on respective surfaces of the stamp wheels 3, from which elements the identifying mark can be put together by rotating the stamp wheels 3 about the mid-axis 4. Using the rotation of the stamp wheels 3, the identifying mark to be stamped for the respective motor vehicle component can be put together individually from the identifier elements.

The identifying mark can comprise a country identifier for a country in which the motor vehicle component is produced and/or a factory identifier for a factory in which the motor vehicle component is machined and/or a part identifier and/or a unique number, changing with the press stroke, which identifies the motor vehicle component uniquely.

In order to permit particularly advantageous documentation of the identifying mark impressed onto the motor vehicle component, provision is made for the embossing stamp 1 to have a transmission device 6 and a receiver device 7. The transmission device 6 and the receiver device 7 are each shown schematically by a small box in the figures. The transmission device 6 is set up to provide an identification signal for an electronic computing device, not illustrated in the figures. The electronic computing device is arranged externally to the embossing stamp and in particular externally to the pressing tool. The identification signal characterizes the identifying mark stamped onto the motor vehicle component and also the motor vehicle component identified with the characterizing mark, so that the motor vehicle component can be stored in the electronic computing device in a manner associated with the respective identifying mark stamped into the motor vehicle component. In this way, particularly simple, automated documentation of respective identifying marks stamped in the motor vehicle component is possible. In particular in the event of an arrangement of the embossing stamp 1 on or in the pressing tool so as to be difficult to see or difficult to access, the particularly simple documentation is made possible by the provision of the identification signal for the electronic computing device using the transmission device 6.

Using the receiver device 7, the identifying mark to be set in the embossing wheel assembly 2 can be controlled particularly simply from outside the embossing stamp 1 and from outside the pressing tool. In particular, using the electronic computing device, it is possible to provide a setting signal which can be received using the receiver device 7. The setting signal characterizes the identifying mark to be set in the embossing wheel assembly 2 and impressed onto the motor vehicle component. The receiver device 7 thus permits setting of the embossing wheel assembly 2 from outside the embossing stamp 1 and/or from outside the pressing tool to be controlled particularly simply. In this way, the embossing wheel assembly 2 can be set particularly simply and quickly, depending on the identifying mark to be stamped, to permit particularly short cycle times during the identification of a plurality of motor vehicle components.

During an identification operation of the motor vehicle, the motor vehicle component is formed in the pressing tool comprising the embossing stamp 1, wherein the motor vehicle component is embossed with the identifying mark using the embossing stamp 1 during the forming. Using the embossing stamp 1, specifically, the transmission device 6 of the embossing stamp 1, the stamped identifying mark is provided via the identification signal for the computing device external to the embossing stamp, which stores the stamped identifying mark in a manner associated with the embossed motor vehicle component.

To permit particularly advantageous documentation of the vehicle component over a machining process of the motor vehicle component comprising a plurality of stations, provision is made for a blank identifier lasered into the motor vehicle component to be formed to be determined using a detection device and to be stored in the computing device in a manner associated with the motor vehicle component. In the computing device, the identifying mark stamped onto the motor vehicle component can thus be stored in a manner associated with the motor vehicle component and the blank identifier. This is advantageous in particular to the effect that, during the forming of the motor vehicle component, the motor vehicle component can be stretched and/or compressed in such a way that the blank identifier cannot be read or can be read only with a great deal of effort. The blank identifier is a marking which has been lasered onto a blank, wherein the blank represents an initial component from which the motor vehicle component has been produced, in particular formed. The storage of the blank identifier in the electronic computing device in a manner associated with the motor vehicle component and the stamped identifying mark makes it possible that, for machining steps following the forming, in which or for which the stamped identifying mark of the motor vehicle component is read, via the electronic computing device or knowledge of a relationship of stamped component number and lasered blank identifier, by storing the link in a database or memory, and via the identifier that is read the blank identifier assigned to the motor vehicle component can be determined.

Using the blank identifier, conclusions can be drawn about material properties and/or process parameters of the motor vehicle component. In particular, the electronic computing device determines via the blank identifier a material and/or at least one process parameter of the motor vehicle component and stores the material and/or the at least one process parameter of the motor vehicle component in a database in a manner associated with the motor vehicle component and/or the identifying mark. In this way, the electronic computing device can provide information about the material and/or the at least one process parameter of the motor vehicle component particularly simply for machining steps of the motor vehicle component that follow the forming.

The embossing stamp 1 and the embossing operation described are based on the finding that, in pressing mechanisms for identifying motor vehicle components, embossing stamps 1, in particular part identification stamps, left/right stamps or counting unit stamps are used. Furthermore, during blank production, blanks are provided in coiling systems with the unique blank identifier, in the present case a biunique serial number, using laser labelling. For these unique blank identifiers, for all the blanks or the motor vehicle components produced from the blanks, the associated material parameters and/or process parameters and quality features are stored in a database.

At the present time, at least two first digits of counting unit stamps have to be set manually, which can often be forgotten or done wrongly. Further digits of counting unit stamps are changed with each press stroke via a mechanism. Furthermore, there is currently no direct assignment of the stamped identifying mark to the material parameters and process parameters of the motor vehicle component. Furthermore, documentation of the stamped identifying mark is currently carried out manually. The blank identifier applied to the blanks using laser labelling in coil systems is difficult to read or no longer legible in directly and indirectly hot-formed motor vehicle components and/or after a varnishing process of the motor vehicle component.

In order to overcome these disadvantages, provision is made for the embossing stamp 1 to be inserted into the pressing tool, which provides the identifying mark currently stamped into the motor vehicle component with stroke accuracy via a data interface, in the present case the transmission device 6, for the electronic computing device. In this way, a connection of the stamped identifying mark with the blank identifier of the blank used as a starting material for the motor vehicle component, and thus a connection between the identifying mark and the material parameters and/or process parameters of the motor vehicle component, can be produced.

As soon as a data-based link between the identifying mark stamped into the motor vehicle component in the press tool and the blank identifier lasered on in the coil system has been produced and stored in the electronic computing device, the stamped identifying mark, which is considerably better visible as compared with the blank identifier, can be used in processes following the forming, for example press hardening for press-hardened steel. To read out the stamped identifying mark, standard cameras can be used instead of expensive special solutions, which makes cost savings in the process possible.

Using the receiver device 7, the embossing stamp 1 can be activated from outside the embossing stamp 1, so that it is possible to control from outside, in particular using the computing device, which identifying mark is to be stamped onto the motor vehicle component.

Overall, the present subject matter shows how a data link for part identification can be produced.

LIST OF DESIGNATIONS

1 Embossing stamp
2 Embossing wheel assembly
3 Stamp wheel
4 Mid-axis
5 Identifier element
6 Transmission device
7 Receiver device

What is claimed is:

1. An embossing stamp for embossing an identifying mark on a motor vehicle component, comprising:

an embossing wheel assembly configured to be set individually for the motor vehicle component to be embossed depending on the identifying mark to be stamped, wherein the embossing wheel assembly includes a negative representation of the identifying mark to be stamped, and a transmission device configured to provide an identification signal characterizing the stamped identifying mark to a computing device external to the embossing stamp, wherein the identification signal characterizes both the identifying mark stamped and the motor vehicle component identified by the identifying mark.

2. The embossing stamp according to claim 1, wherein the identifying mark characterizes a country and/or a factory and/or a part identifier.

3. The embossing stamp according to claim 1, wherein the embossing wheel assembly comprises a plurality of stamp wheels each configured to be rotated about a mid-axis to set the identifying mark to be stamped, and the plurality of stamp wheels each comprise a plurality of identifier elements on respective circumferences from which the identifying mark can be selected or put together.

4. A pressing tool for forming a motor vehicle component, comprising:

an embossing stamp according to claim 1, wherein the identifying mark can be stamped during forming of the motor vehicle component.

5. The pressing tool of claim 4, wherein the pressing tool is configured to compress and/or stretch a blank identifier lasered into the motor vehicle component to be formed.

6. The embossing stamp according to claim 1, wherein the identification signal characterizes the stamped identifying mark and the motor vehicle component such that the stamped identifying mark is configured to be stored in association with the motor vehicle component in a memory of the computing device.

7. An embossing stamp for embossing an identifying mark on a motor vehicle component, comprising:

an embossing wheel assembly configured to be set individually for the motor vehicle component to be embossed depending on the identifying mark to be stamped, wherein the embossing wheel assembly includes a negative representation of the identifying mark to be stamped, a transmission device configured to provide an identification signal characterizing the stamped identifying mark to a computing device external to the embossing stamp; and a receiver device configured to receive a setting signal provided by the computing device, wherein the setting signal characterizes an identifying mark to be set in the embossing wheel assembly for the embossing wheel assembly.

8. The embossing stamp according to claim 7, wherein the identification signal characterizes the stamped identifying mark and the motor vehicle component such that the stamped identifying mark is configured to be stored in association with the motor vehicle component in a memory of the computing device.

9. The embossing stamp according to claim 7, wherein the identifying mark characterizes a country and/or a factory and/or a part identifier.

10. The embossing stamp according to claim 7, wherein the embossing wheel assembly comprises a plurality of stamp wheels each configured to be rotated about a mid-axis to set the identifying mark to be stamped, and the plurality of stamp wheels each comprise a plurality of identifier elements on respective circumferences from which the identifying mark can be selected or put together.

11. A pressing tool for forming a motor vehicle component, comprising:

an embossing stamp according to claim 7, wherein the identifying mark can be stamped during forming of the motor vehicle component.

12. The pressing tool of claim 11, wherein the pressing tool is configured to compress and/or stretch a blank identifier lasered into the motor vehicle component to be formed.

13. A method for identifying a motor vehicle component, comprising:

forming and/or processing a motor vehicle component in a pressing tool;

embossing the motor vehicle component with an identifying mark using an embossing stamp during the forming and/or processing in the pressing tool;

providing, using the embossing stamp, the embossed identifying mark to a computing device external to the embossing stamp;

storing the embossed identifying mark in a memory of the computing device in a manner associated with the embossed motor vehicle component;

determining a blank identifier lasered into the motor vehicle component to be formed; and storing the blank identifier in a memory of the computing device in a manner associated with the motor vehicle component and the identifying mark.

14. The method according to claim 13, further comprising:

receiving, using a receiver device, a setting signal characterizing an identifying mark to be set in the embossing stamp;

providing the setting signal to the embossing stamp;

setting the identifying mark to be set in the embossing stamp; and stamping the identifying mark into the motor vehicle component using the embossing stamp.

15. The method according to claim 13, further comprising:

determining, depending on the blank identifier determined, a material and/or at least one process parameter of the motor vehicle component; and storing the material and/or the at least one process parameter in a memory of the computing device in a manner associated with the motor vehicle component.

16. The method according to claim 13, wherein the blank identifier is a marking that represents an initial component from which the motor vehicle component has been formed.

17. The method of claim 13, further comprising:

compressing and/or stretching the blank identifier during the forming and/or processing of the motor vehicle component.

* * * * *